US008084933B2

(12) United States Patent
Park et al.

(10) Patent No.: US 8,084,933 B2
(45) Date of Patent: Dec. 27, 2011

(54) INORGANIC ELECTROLUMINESCENT DEVICE AND METHOD OF MANUFACTURING THE SAME

(75) Inventors: Shang-hyeun Park, Yongin-si (KR); Min-jong Bae, Yongin-si (KR); Tae-won Jeong, Yongin-si (KR); Young-chul Ko, Yongin-si (KR)

(73) Assignee: Samsung Electronics Co., Ltd. (KR)

( * ) Notice: Subject to any disclaimer, the term of this patent is extended or adjusted under 35 U.S.C. 154(b) by 137 days.

(21) Appl. No.: 12/508,027

(22) Filed: Jul. 23, 2009

(65) Prior Publication Data

US 2010/0109520 A1 May 6, 2010

(30) Foreign Application Priority Data

Nov. 4, 2008 (KR) ..... 10-2008-0109037

(51) Int. Cl.
*H05B 33/26* (2006.01)

(52) U.S. Cl. ..... 313/500; 445/24

(58) Field of Classification Search ..... 313/500–512; 445/24–25; 435/183
See application file for complete search history.

(56) References Cited

U.S. PATENT DOCUMENTS

| | | | | |
|---|---|---|---|---|
| 2003/0034729 | A1* | 2/2003 | Yano et al. | 313/503 |
| 2007/0120136 | A1* | 5/2007 | Noda et al. | 257/98 |
| 2008/0061683 | A1* | 3/2008 | Bertram | 313/504 |
| 2008/0108122 | A1* | 5/2008 | Paul et al. | 435/183 |

FOREIGN PATENT DOCUMENTS

| | | |
|---|---|---|
| JP | 2000-200687 | 7/2000 |
| JP | 2003-249346 | 9/2003 |
| JP | 2006-244768 | 9/2006 |

OTHER PUBLICATIONS

Text of WO 2005/059636, published Jun. 30, 2005.*

* cited by examiner

*Primary Examiner* — Nimeshkumar Patel
*Assistant Examiner* — Mary Ellen Bowman
(74) *Attorney, Agent, or Firm* — Cantor Colburn LLP

(57) ABSTRACT

An inorganic electroluminescence ("EL") device includes a lower electrode; a dielectric layer disposed on the lower electrode; an inorganic emission layer disposed on the dielectric layer; an upper electrode disposed on the inorganic emission layer; a waveguide layer disposed on the upper electrode; and a reflection film partially coating the waveguide layer and including an emission portion through which light is emitted.

20 Claims, 4 Drawing Sheets

INORGANIC ELECTROLUMINESCENT DEVICE AND METHOD OF MANUFACTURING THE SAME

CROSS-REFERENCE TO RELATED APPLICATIONS

This application claims priority to Korean Patent Application No. 10-2008-0109037, filed on Nov. 4, 2008, and all the benefits accruing therefrom under 35 U.S.C. §119, the contents of which in its entirety are herein incorporated by reference.

BACKGROUND

1. Field

One or more embodiments relate to an inorganic electroluminescent ("EL") device and a method of manufacturing the same.

2. Description of the Related Art

Inorganic electroluminescent ("EL") devices are used as lamp-type light sources in cellular phone keypads, advertisement plates, medical equipment and the like. FIG. 1 is a schematic cross-section of a commercially available inorganic EL device. In the inorganic EL device of FIG. 1, a lower electrode 11 is formed on a substrate 10, a dielectric layer 12 is formed on the lower electrode 11, an inorganic emission layer 13 is formed on the dielectric layer 12 and an upper electrode 14 is formed on the inorganic emission layer 13. When a predetermined voltage is applied between the lower electrode 11 and the upper electrode 14 of the inorganic EL device, electrons are emitted from the dielectric layer 12 and accelerated by an electric field formed within the inorganic emission layer 13, and thus collide with phosphors included in the inorganic emission layer 13. Accordingly, red ("R") visible light, green ("G") visible light and blue ("B") visible light are emitted from their respective phosphors, thereby forming an image. Although the inorganic EL is very thin, inexpensive and flexible, it provides low brightness, thus can have too little luminance for illumination of a display. However, there is a recent trend to increase the size of displays, such as a digital information displays ("DIDs"), home displays and the like. Therefore to facilitate application of inorganic EL devices to displays, including large displays, an inorganic EL device with improved brightness is needed.

Japanese Publication Patent No. 2006-244768 discloses an EL device in which an EL layer, a transparent electrode layer and a transparent substrate are sequentially stacked, a light diffusion layer is formed between the transparent electrode layer and the transparent substrate and a reflection-prevention film is formed on the light diffusion layer, wherein the light diffusion layer diffuses light guided by the transparent electrode layer as a waveguide.

However, the EL device disclosed in Japanese Publication Patent No. 2006-244768 has a limit in improving brightness and fails to provide clear colors, this light efficiency can be degraded.

SUMMARY

One or more embodiments include an inorganic electroluminescent ("EL") device that provides improved brightness and improved light efficiency by increasing external light extraction efficiency, and a method of manufacturing the inorganic EL device.

One or more embodiments include a method of manufacturing an inorganic EL device.

Additional aspects, features and advantages are set forth in part in the description which follows and, in part, are apparent from the description.

One or more embodiments includes an inorganic EL device including a lower electrode; a dielectric layer disposed on the lower electrode; an inorganic emission layer disposed on the dielectric layer; an upper electrode disposed on the inorganic emission layer; a waveguide layer disposed on the upper electrode; and a reflection film partially coating the waveguide layer and including an emission portion through which light is emitted.

A thickness of the waveguide layer may be between about 0.5 times and about 5 times greater than a width of the emission portion.

The waveguide layer may include a material selected from the group consisting of polydimethylsiloxane ("PDMS"), SU-8 polymer and a combination including at least one of the foregoing materials. A light-emission area of the inorganic EL device can be between about 1.1 times and about 3 times greater than an area of a pixel, which is defined as an area where the lower and upper electrodes overlap each other.

The inorganic EL device may further include a dielectric layer disposed between the inorganic emission layer and the upper electrode.

The inorganic emission layer may include a red phosphor, a green phosphor, a blue phosphor or a combination including at least one of the foregoing phosphors.

One or more embodiments includes an inorganic EL device including a substrate; a waveguide layer disposed on a bottom surface of the substrate; a reflection film partially coating the waveguide layer and including an emission portion through which light is emitted; a lower electrode disposed on a top surface of the substrate; an inorganic emission layer disposed on the lower electrode; a dielectric layer disposed on the inorganic emission layer; and an upper electrode disposed on the dielectric layer.

The inorganic EL device may further include a dielectric layer disposed between the inorganic emission layer and the lower electrode.

One or more embodiments includes a method of manufacturing an inorganic EL device, the method including sequentially disposing a lower electrode, a dielectric layer, an inorganic emission layer and an upper electrode; disposing a waveguide layer on the upper electrode; and partially coating the waveguide layer with a reflection film including an emission portion through which light is emitted.

The waveguide layer may be disposed using a photolithographic process.

The waveguide layer may be disposed using an imprint process.

A method of manufacturing an inorganic electroluminescent device, the method including: sequentially disposing a lower electrode, an inorganic emission layer, a dielectric layer, and an upper electrode; disposing a waveguide on the lower electrode; and disposing a reflection film on the waveguide, wherein the reflection film has an emission portion through which light is emitted.

In an embodiment, the substrate can be interposed between the waveguide and the lower electrode.

BRIEF DESCRIPTION OF THE DRAWINGS

These and/or other aspects, advantages and features will become apparent and more readily appreciated from the following description of the embodiments, taken in conjunction with the accompanying drawings in which.

DETAILED DESCRIPTION

Figure 1:
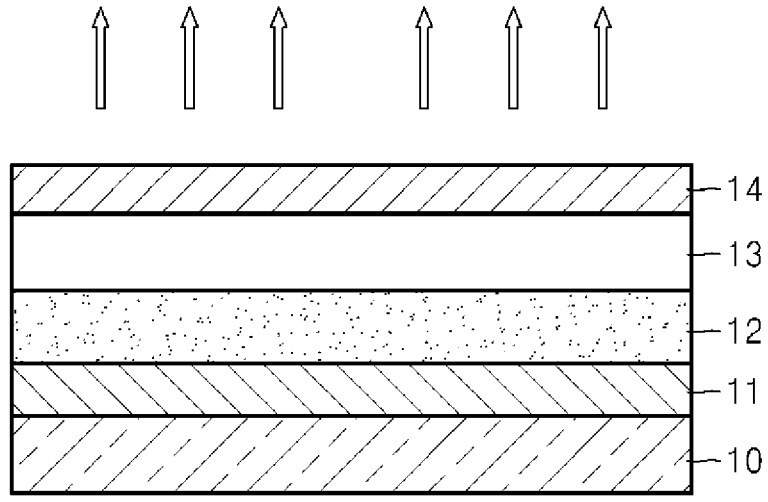
FIG. 1 (PRIOR ART)
FIG. 1 is a schematic cross-section of a prior art inorganic electroluminescent ("EL") device.

Reference will now be made in further detail to embodiments, examples of which are illustrated in the accompanying drawings, wherein like reference numerals refer to the like elements throughout. In this regard, the present embodiments may have different forms and should not be construed as being limited to the descriptions set forth herein. Accordingly, the embodiments are merely described below, by referring to the figures, to explain aspects of the disclosed embodiments.

It will be understood that when an element or layer is referred to as being "on" or "connected to" another element or layer, the element or layer can be directly on or connected to another element or layer or intervening elements or layers. In contrast, when an element is referred to as being "directly on" or "directly connected to" another element or layer, there are no intervening elements or layers present. As used herein, the term "and/or" includes any and all combinations of one or more of the associated listed items.

It will be understood that, although the terms first, second, third, etc., can be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the exemplary embodiments of the invention.

Spatially relative terms, such as "below," "lower," "upper" and the like, can be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "lower" relative to other elements or features would then be oriented "above" relative to the other elements or features. Thus, the exemplary term "below" can encompass both an orientation of above and below. The device can be otherwise oriented (rotated 90 degrees or at other orientations) and the spatially relative descriptors used herein interpreted accordingly.

As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the invention are described herein with reference to cross-section illustrations that are schematic illustrations of idealized embodiments (and intermediate structures) of the invention. As such, variations from the shapes of the illustrations as a result, for example, of manufacturing techniques and/or tolerances, are to be expected. Thus, embodiments of the invention should not be construed as limited to the particular shapes of regions illustrated herein but are to include deviations in shapes that result, for example, from manufacturing.

For example, an implanted region illustrated as a rectangle will, typically, have rounded or curved features and/or a gradient of implant concentration at its edges rather than a binary change from implanted to non-implanted region. Likewise, a buried region formed by implantation can result in some implantation in the region between the buried region and the surface through which the implantation takes place. Thus, the regions illustrated in the figures are schematic in nature and their shapes are not intended to illustrate the actual shape of a region of a device and are not intended to limit the scope of the invention.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

All methods described herein can be performed in a suitable order unless otherwise indicated herein or otherwise clearly contradicted by context. The use of any and all examples, or exemplary language (e.g., "such as"), is intended merely to better illustrate the invention and does not pose a limitation on the scope of the invention unless otherwise claimed. No language in the specification should be construed as indicating any non-claimed element as essential to the practice of the invention as used herein.

Figure 2A:
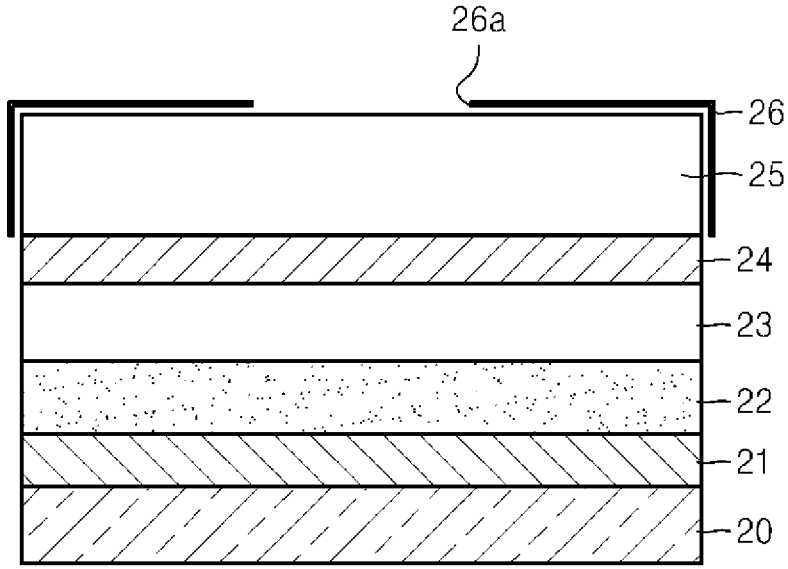
FIG. 2A is a schematic cross-section of an exemplary embodiment of an inorganic EL device.

FIG. 2A is a schematic cross-section of an exemplary embodiment of an inorganic electroluminescent ("EL") device. Referring to FIG. 2A, the inorganic EL device includes a lower electrode 21 disposed on a substrate 20, a dielectric layer 22 disposed on the lower electrode 21, an inorganic emission layer 23 disposed on the dielectric layer 22, an upper electrode 24 disposed on the inorganic emission layer 23, a waveguide layer 25 disposed on the upper electrode 24 and a reflection film 26, which partially covers the waveguide layer 25 and has an emission portion 26*a* disposed therein. In an embodiment, external light extraction efficiency is increased due to the inclusion of the waveguide layer 25 and the reflection film 26, thereby improving the brightness and light efficiency of the inorganic EL device.

A transparent substrate may be used as the substrate 20. In an embodiment, the substrate 20 can comprise a glass, a plastic, or the like or a combination comprising at least one of the foregoing materials. Although not shown in FIG. 2A, an upper substrate may be further disposed on the upper electrode 24. A transparent substrate may be used as the upper substrate. In an embodiment, the upper substrate can comprise a glass, a plastic substrate or the like or a combination comprising at least one of the foregoing materials.

The lower electrode 21 can comprise a metal, a transparent conductive material, or the like or a combination comprising at least one of the foregoing materials. An exemplary transparent conductive material is indium tin oxide ("ITO"), however, the embodiment is not limited to this example.

The dielectric layer 22 may comprise barium titanate ($BaTiO_3$), silicon oxide, or the like or a combination comprising at least one of the foregoing materials, however, the embodiment is not limited to these materials.

The inorganic emission layer 23 can comprise an inorganic phosphor. The inorganic phosphor may comprise a compound selected from the group consisting of ZnS, SrS, BaS, GaS, ZnO, ZnSe, GaN, GaP, and the like and a combination comprising at least one of the foregoing. The inorganic phosphor may consist essentially of a compound selected from the group consisting of ZnS, SrS, BaS, GaS, ZnO, ZnSe, GaN, GaP, and the like and a combination thereof. The inorganic phosphor may consist of a compound selected from the group consisting of ZnS, SrS, BaS, GaS, ZnO, ZnSe, GaN, GaP and a combination thereof. In an embodiment, the inorganic emission layer 23 may include a red phosphor, which emits red light, a green phosphor, which emits green light and a blue phosphor, which emits blue light. The red phosphor may comprise ZnS:Cu, Cl, Mn, or the like, the green phosphor may comprise ZnS:Cu, Al, ZnS:Cu, Cl, or the like, and the blue phosphor may comprise ZnS:Cu, Cl, or the like. The red phosphor may consist essentially of ZnS:Cu, Cl, Mn, or the like, the green phosphor may consist essentially of ZnS:Cu, Al, ZnS:Cu, Cl, or the like, and the blue phosphor may consist essentially of ZnS:Cu, Cl, or the like. The red phosphor may consist of ZnS:Cu, Cl, Mn, the green phosphor may consist of ZnS:Cu, Al, ZnS:Cu, Cl, and the blue phosphor may consist of ZnS:Cu, Cl.

In an embodiment, the upper electrode 24 is disposed on a top surface of the inorganic emission layer 23. The upper electrode 24 may comprise a transparent conductive material. An exemplary transparent conductive material is ITO, however, the embodiment is not limited to this example.

A refractive index of the waveguide layer 25 may be in a range of about 1 to about 2, specifically in a range of about 1.3 to about 1.75, more specifically about 1.5. In an embodiment, the refractive index of the waveguide layer 25 may be in the range of about 1.4 to about 1.7. The waveguide layer 25 may comprise a transparent resin material. In an embodiment, the waveguide layer 25 may consist essentially of a transparent resin material. In another embodiment, the waveguide layer 25 may consist of a transparent resin material. The waveguide layer 25 may comprise a material selected from the group consisting of polydimethylsiloxane ("PDMS"), SU-8 polymer, and the like and a combination comprising at least one of the foregoing materials. In an embodiment, the waveguide layer 25 may consist essentially of a material selected from the group consisting of polydimethylsiloxane ("PDMS"), SU-8 polymer, and the like and a combination thereof. In an embodiment, the waveguide layer 25 may consist of a material selected from the group consisting of polydimethylsiloxane ("PDMS"), SU-8 polymer, and the like and a combination thereof. The waveguide layer 25 may be disposed using a film formation method, such as spin coating, blade coating, an inkjet method, or the like or a combination comprising at least one of the foregoing methods. In an embodiment, the waveguide layer 25 may be disposed using a photolithographic process, an imprint process, or the like or a combination comprising at least one of the foregoing processes. A thicker waveguide layer 25 can provide higher light extraction efficiency. In an embodiment, a thickness of the waveguide layer 25 may be between about 1 micrometer ("μm") and about 100 μm, specifically between about 3 μm and about 50 μm, more specifically between about 3 μm and about 30 μm. In an embodiment, the waveguide layer 25 can have a thickness greater than or equal to 1 μm. In another embodiment, the thickness of the waveguide layer 25 may be selected to be between about 0.5 times and about 5 times, specifically between about 1 times and about 4 times, more specifically between about 2 times and about 3 times greater than a width of the emission portion 26*a* of the reflection film 26. In an embodiment, the thickness of the waveguide layer 25 may be selected to be between about 1 times and about 5 times, specifically between about 2 times and about 5 times, more specifically between about 3 times and about 4 times greater than the width of the emission portion 26*a* of the reflection film 26.

The reflection film 26 can comprise a metal having a high reflectivity. In an embodiment, the reflection film 26 may be disposed by depositing aluminum, silver or the like and then patterning the deposited aluminum, silver, or the like by method such as photolithography, or the like. The reflection film 26 has the emission portion 26*a*, which partially covers the waveguide layer 25 and through which light is emitted. The width of the emission portion 26*a* may depend on the thickness of the waveguide layer 25. Alternatively, the width of the emission portion 26*a* may depend on the resolution of the inorganic EL device. In another embodiment, when the lower electrode 21 is not a reflection electrode, a reflection film may be further disposed on the lower electrode 21.

In the inorganic EL device, when a voltage is applied between the lower electrode 21 and the upper electrode 24, electrons are emitted from the dielectric layer 22 to the inorganic emission layer 23, where a direct current ("DC") or an alternating current ("AC") voltage may be applied between the lower electrode 21 and the upper electrode 24. The electrons emitted from the dielectric layer 22 are accelerated by an electrical field formed within the inorganic emission layer 23 and thus collide with a phosphor in the inorganic emission layer 23. Then, light is emitted from the phosphor, and the emitted light passes through the upper electrode 24 and is incident upon the waveguide layer 25. A part of the light incident upon the waveguide layer 25 is emitted to the outside via the emission portion 26*a* of the reflection film 26, or is guided toward the emission portion 26*a* by the reflection film 26 and then is emitted to the outside, thereby forming an image.

In an inorganic EL device, because light is emitted at a place where a lower electrode and an upper electrode intersect, a light emission area can be selected according to the resolution of the inorganic EL device. If only the intersection of the lower electrode and the upper electrode is used as the light emission area, a contrast of the inorganic EL device is significantly decreased. In an embodiment, the waveguide layer 25 is disposed to be as large as possible by having an area, which is the same as an area of the inorganic emission layer 23, and then guides light to the emission portion 26*a* via the reflection film 26, thereby increasing the light emission area and the contrast of the inorganic EL device. In an embodiment, the reflection film 26 may be disposed to have an area, which is the same as that of a pixel.

Figure 2B:
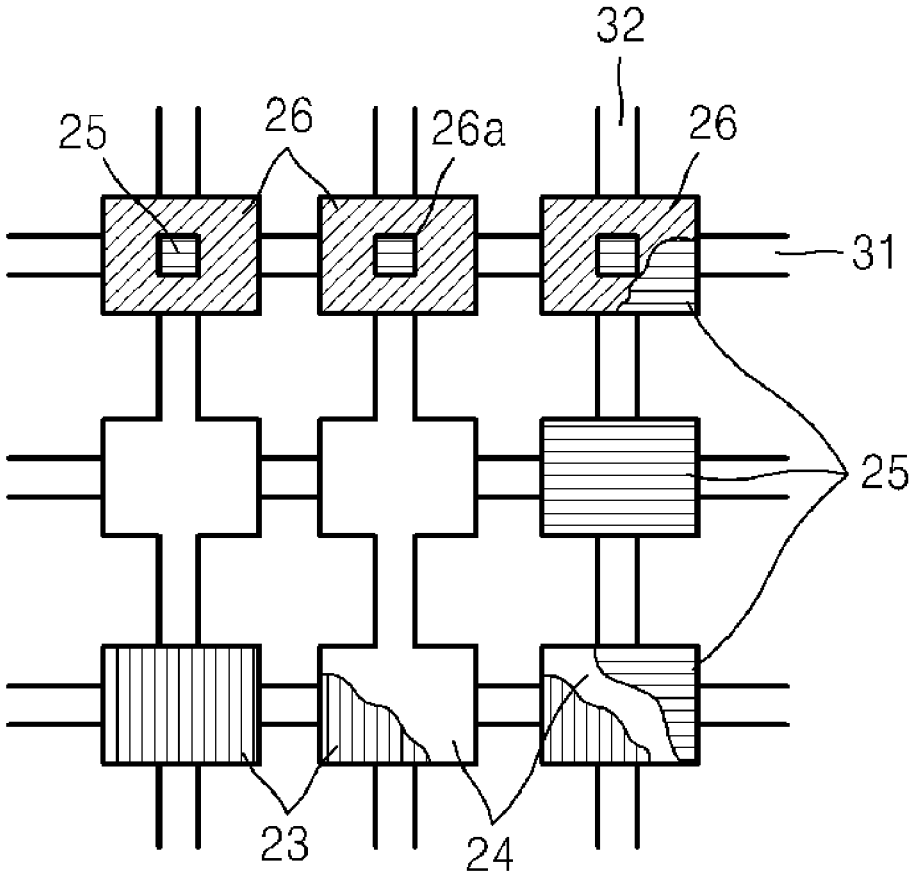
FIG. 2B is a plan view of part of an exemplary embodiment of a passive matrix of the inorganic EL device illustrated in FIG. 2A.

FIG. 2B is a plan view of part of an exemplary embodiment of a passive matrix of the inorganic EL device illustrated in FIG. 2A. Referring to FIG. 2B, the upper electrode 24 may be disposed on the inorganic emission layer 23, and then the waveguide layer 25 may be disposed on the upper electrode 24. The reflection film 26, having the emission portion 26*a*, is disposed on the waveguide layer 25. In an embodiment, a light-emission area may be between about 1.1 times and about 3 times, specifically between about 1.5 times and about 2.7 times, more specifically about 2 times greater than the area of a pixel. In another embodiment, the light-emission area may be between about 1.5 times and about 2.7 times greater than the area of a pixel. In an embodiment wherein the lower and upper electrodes 23 and 24 are arranged linearly, the pixel area may be defined as an area where a lower electrode line 31, which can be disposed in a row direction, and an upper electrode line 32, which can be disposed in a column direction, overlap each other. The light-emission area denotes the area of the inorganic emission layer 23. As illustrated in FIG. 2B, the lower electrode 21 and the upper electrode 24 may extend to an extent that is allowed by the resolution of the device, and thus the light-emission area may be increased accordingly. The size of the emission portion 26*a* may be between about 0.5 times and about 3 times, specifically between about 0.7 times and about 2 times, more specifically between about 1 times and about 1.5 times greater than the pixel area. In an embodiment, the size of the emission portion 26*a* may be between about 0.5 times and about 2 times, specifically between about 0.8 times and about 1.5 times, more specifically between about 0.9 times and about 1.3 times greater than the pixel area.

Figure 3:
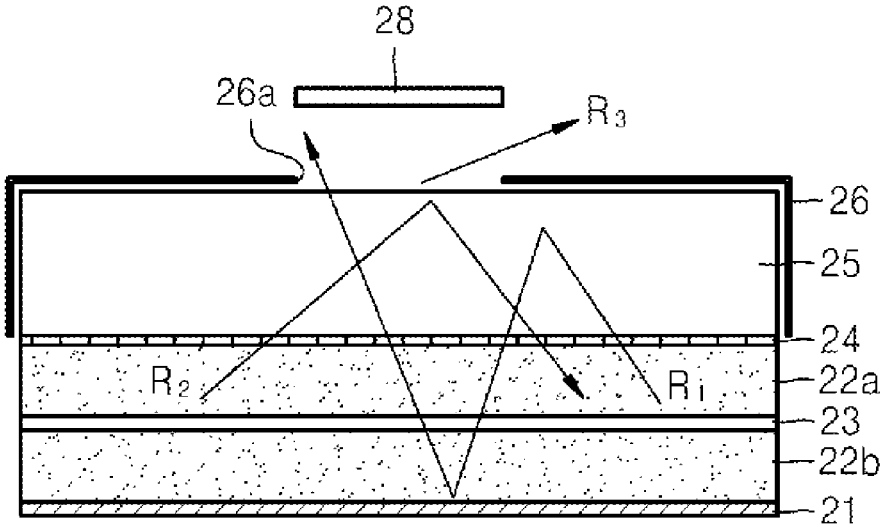
FIG. 3 is a diagram illustrating light-emission of the inorganic EL of FIG. 2A.

FIG. 3 is a diagram illustrating a light-emission of the inorganic EL device of FIG. 2A. As illustrated in FIG. 3, a first dielectric layer 22*b*, an inorganic emission layer 23, a second dielectric layer 22*a*, an upper electrode 24, and a waveguide layer 25 may be sequentially disposed on the lower electrode 21, and then the reflection film 26 partially covering the waveguide layer 25 may be disposed on the resultant stacked structure. The inorganic emission layer 23 may be interposed between the first dielectric layer 22*b* and the second dielectric layer 22*a*. Some light R1 reflects off the reflection film 26 and the lower electrode 21 and is guided to the outside through the emission portion 26*a*. Other light R2 is blocked by the reflection film 26. Even if the light, such as light R3, passes through the reflection film 26, the light may not reach a detector 28. Since light emitted from the inorganic emission layer 23, which can have an enlarged light-emission area according to the above-described process, is guided by the waveguide layer 25 and the reflection film 26, the amount of light emitted via the emission portion 26*a* increases. The detector 28 detects the amount of light. Although the lower electrode 21 is a reflection electrode in the inorganic EL device of FIG. 3, the present embodiment is not limited thereto, and thus, the lower electrode 21 may comprise a reflection film, for example.

In an embodiment, the waveguide layer 25 may be disposed on a surface of the substrate 20, which is opposite to a surface on which the lower electrode 21, the dielectric layer 22, the inorganic emission layer 23 and the upper electrode 24 are disposed.

Figure 4:
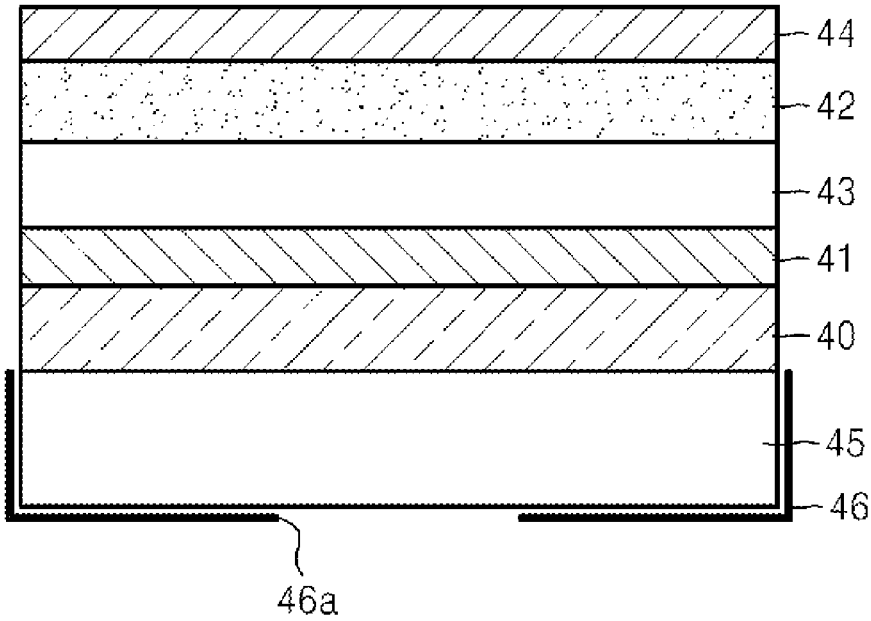
FIG. 4 is a schematic cross-section of an exemplary embodiment of an inorganic EL device.

FIG. 4 is a schematic cross-section of an inorganic EL device according to another embodiment. Referring to FIG. 4, the inorganic EL device includes a waveguide layer 45 disposed on a bottom surface of a substrate 40, a reflection film 46 which partially covers the waveguide layer 45 and has an emission portion 46*a* through which light is emitted, a lower electrode 41 disposed on a top surface of the substrate 40, an inorganic emission layer 43 disposed on the lower electrode 41, a dielectric layer 42 disposed on the inorganic emission layer 43, and an upper electrode 44 disposed on the dielectric layer 42. In another embodiment, a dielectric layer may be disposed between the inorganic emission layer 43 and the lower electrode 41.

A refractive index of the waveguide layer 45 may be in a range of about 1 to about 2, specifically in a range of about 1.3 and about 1.75, more specifically about 1.5. In an embodiment, the refractive index of the waveguide layer 25 may be in a range of about 1.4 to about 1.7. A transparent resin may be used to form the waveguide layer 45. In an embodiment, the waveguide layer 45 may comprise a material selected from the group consisting of PDMS, SU-8 polymer, and the like and a combination comprising at least one of the foregoing materials. In an embodiment, the waveguide layer 45 may consist essentially of a material selected from the group consisting of PDMS, SU-8 polymer, and the like and a combination thereof. In an embodiment, the waveguide layer 45 may consist of a material selected from the group consisting of PDMS, SU-8 polymer, and the like and a combination thereof. The waveguide layer 45 may be disposed using a film formation method, such as spin coating, blade coating, an inkjet method or the like, or a combination comprising at least one of the foregoing methods. In an embodiment, the waveguide layer 45 may be disposed using a photolithographic process, an imprint process, or the like or a combination comprising at least one of the foregoing processes. A thicker waveguide layer 45 can provide higher light extraction efficiency. In an embodiment, a thickness of the waveguide layer 45 may be between about 1 micrometer ("μm") and about 100 μm, specifically between about 3 μm and about 50 μm, more specifically between about 3 μm and about 30 μm. In another embodiment, the thickness of the waveguide layer 45 may be selected to be between about 0.5 times and about 5 times, specifically between about 1 times and about 4 times, more specifically between about 2 times and about 3 times greater than a width of the emission portion 46*a* of the reflection film 46. In an embodiment, the thickness of the waveguide layer 45 may be selected to be between about 1 times and about 5 times, specifically between about 2 times and about 5 times, more specifically between about 3 times and about 4 times greater than the width of the emission portion 46*a* of the reflection film 46.

The reflection film 46 can comprise a metal having a high reflectivity. In an embodiment, the reflection film 46 may be disposed by depositing aluminum, silver, or the like and then patterning the aluminum, the silver, or the like by a method such as photolithography, or the like. In an embodiment, the reflection film 46 may comprise aluminum. In another embodiment, the reflection film 46 may consist essentially of aluminum. In another embodiment, the reflection film 46 may consist of aluminum. The reflection film 46 has the emission portion 46*a*, which partially covers the waveguide layer 45 and through which light is emitted. The width of the emission portion 46*a* may depend on the thickness of the waveguide layer 45.

The substrate 40 can comprise a transparent substrate. In an embodiment, the substrate 40 can comprise a glass, a plastic substrate, or the like or a combination comprising at least one of the foregoing materials. Although not shown in FIG. 4, an upper substrate may be further formed on the upper electrode 44 as a transparent substrate. In an embodiment, the upper substrate can comprise a glass, a plastic substrate, or the like or a combination comprising at least one of the foregoing materials.

The lower electrode 41 can comprise a transparent conductive material. An exemplary transparent conductive material is indium tin oxide ("ITO"), however, the present embodiment is not limited to this example.

The inorganic emission layer 43 can comprise an inorganic phosphor. The inorganic phosphor may comprise a compound selected from the group consisting of ZnS, SrS, BaS, GaS, ZnO, ZnSe, GaN, GaP, and the like and a combination comprising at least one of the foregoing. The inorganic phosphor may consist essentially of a compound selected from the group consisting of ZnS, SrS, BaS, GaS, ZnO, ZnSe, GaN, GaP, and the like and a combination thereof. The inorganic phosphor may consist of a compound selected from the group consisting of ZnS, SrS, BaS, GaS, ZnO, ZnSe, GaN, GaP and a combination thereof. In an embodiment, the inorganic emission layer 43 may include a red phosphor, which emits red light, a green phosphor, which emits green light and a blue phosphor, which emits blue light. The red phosphor may comprise ZnS:Cu, Cl, Mn, or the like, the green phosphor may comprise ZnS:Cu, Al, ZnS:Cu, Cl, or the like, and the blue phosphor may comprise ZnS:Cu, Cl, or the like. The red phosphor may consist essentially of ZnS:Cu, Cl, Mn, or the like, the green phosphor may consist essentially of ZnS:Cu, Al, ZnS:Cu, Cl, or the like, and the blue phosphor may consist essentially of ZnS:Cu, Cl, or the like. The red phosphor may consist of ZnS:Cu, Cl, Mn, the green phosphor may consist of ZnS:Cu, Al, ZnS:Cu, Cl, and the blue phosphor may consist of ZnS:Cu, Cl.

The dielectric layer 42 may comprise silicon oxide, or the like, however, the present embodiment is not limited to this example.

The upper electrode 44 is disposed on a top surface of the dielectric layer 42. The upper electrode 44 may comprise a metal, a transparent conductive material, or the like or a combination comprising at least one of the foregoing materials. An exemplary transparent conductive material is ITO, however, the present embodiment is not limited to this example.

A method of manufacturing an inorganic EL device is further described below. In an embodiment, referring to FIG. 2A, the lower electrode 21, the dielectric layer 22, the inorganic emission layer 23, and the upper electrode 24 are sequentially disposed on the substrate 20, the waveguide layer 25 is disposed on the upper electrode 24 and is coated with the reflection film 26, which has the emission portion 26*a* through which light is emitted.

The waveguide layer 25 may be disposed using a film forming method, such as spin coating, blade coating, an inkjet method, or the like or a combination comprising at least one of the foregoing methods. In an embodiment, the waveguide layer 25 may be disposed using a photolithographic process, an imprint process or a combination comprising at least one of the foregoing processes. The waveguide layer is disposed to have an area, which is the same as an area of the inorganic emission layer 23. The inorganic emission layer 23 may be disposed so that its area does not exceed about 3 times the area of a pixel. Due to the inclusion of the waveguide layer 25 and the reflection film 26, a light-emission area may be increased. Thus, brightness and light efficiency of an organic EL device are increased. A thickness of the waveguide layer 25 may be between about 0.5 times and about 5 times, specifically between about 1 times and about 4 times, more specifically between about 2 times and about 3 times greater than a width of the emission portion 26*a*. In an embodiment, the waveguide layer 25 may be disposed to have a thickness between about 1 times and about 5 times, specifically between about 2 times and about 5 times, more specifically between about 3 times and about 4 times greater than the width of the emission portion 26*a*.

The reflection film 26 may coat the waveguide layer 25, and may be disposed by depositing aluminum, silver, or the like and then patterning the aluminum, the silver, or the like by a method such as photolithography, or the like. For example, the reflection film 26 may comprise aluminum. In an embodiment, the emission portion 26*a* of the reflection film 26 may have an area between about 1 $\mu m^2$ and about 100 $\mu m^2$, specifically between about 5 $\mu m^2$ and about 40 $\mu m^2$, more specifically between about 10 $\mu m^2$ and about 20 $\mu m^2$.

It should be understood that the exemplary embodiments described herein should be considered in a descriptive sense only and not for purposes of limitation. Descriptions of features or aspects within each embodiment should typically be considered as available for other similar features or aspects in other embodiments.

EXAMPLES 1 THROUGH 6

A $SiO_2$ dielectric layer of 0.2 μm, a PDMS emission layer, a $SiO_2$ dielectric layer of 0.4 μm, an ITO electrode, and a PDMS waveguide layer having a refractive index of 1.5 were sequentially formed on an Al electrode, and an Al reflection film was formed on a top surface and a lateral surface of the PDMS waveguide layer, thereby manufacturing an inorganic EL device. The emission portion formed on the PDMS waveguide layer had dimensions of 10 μm by 10 μm. An area of the PDMS waveguide layer was increased while changing a height of the PDMS waveguide layer from 0 μm to 20 μm, and the amount of light was measured.

COMPARATIVE EXAMPLE 1

An inorganic EL device was formed in Comparative Example 1 in the same way as in Example 1, except that the PDMS waveguide layer was omitted.

Figure 5:
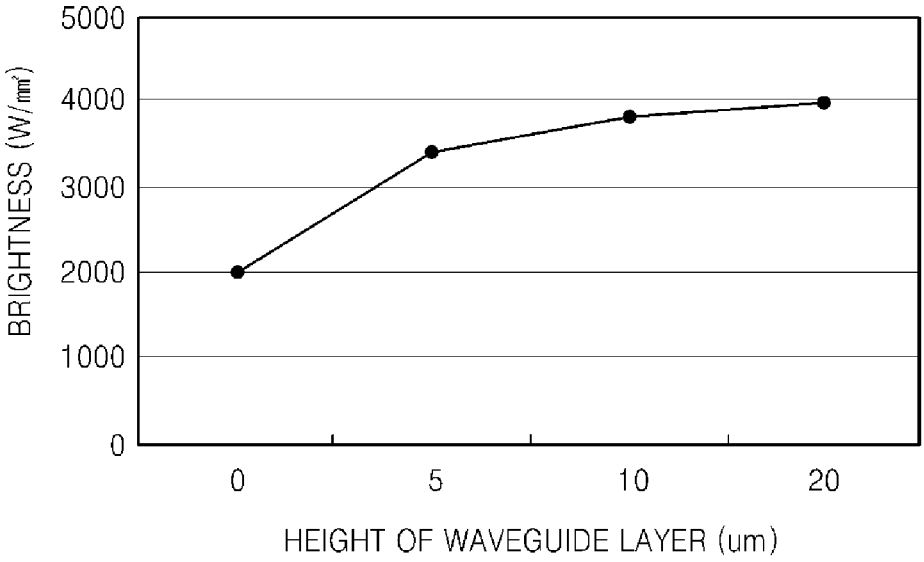
FIG. 5 is a graph showing brightness with respect to waveguide height when the area of a light emission layer is three times greater than an area of a pixel, according to an embodiment.
Figure 6:
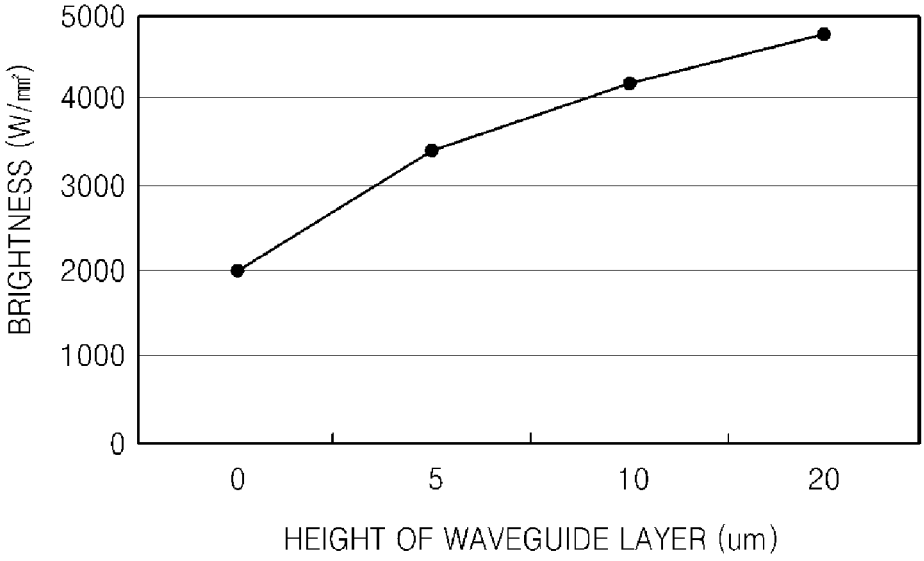
FIG. 6 is a graph showing brightness with respect to waveguide height when the area of the light emission layer is five times greater than an area of a pixel, according to another embodiment.

Results of the experiments are shown in Table 1 below. In these experiments the area of the PDMS emission layer was 3 times and 5 times greater than the pixel area, and an amount of light, reported as brightness, with respect to the height of the PDMS waveguide layer, is shown in FIGS. 5 and 6.

TABLE 1

| | | Height of PDMS waveguide layer (μm) | Area of emission portion ($\mu m^2$) | Area of PDMS emission layer ($\mu m^2$) | Height of detector (μm) | Area of detector ($\mu m^2$) | Measured light amount ($W/mm^2$) |
|---|---|---|---|---|---|---|---|
| Example | 1 | 5 | 10 | 30 × 10 | 10 | 10 | 3402 |
| | 2 | 5 | 10 | 50 × 10 | 10 | 10 | 3385 |
| | 3 | 10 | 10 | 30 × 10 | 10 | 10 | 3832 |
| | 4 | 10 | 10 | 50 × 10 | 10 | 10 | 4129 |
| | 5 | 20 | 10 | 30 × 10 | 10 | 10 | 3994 |
| | 6 | 20 | 10 | 50 × 10 | 10 | 10 | 4693 |
| Comparative Example 1 | | — | 10 | 10 × 10 | 10 | 10 | 1995 |

*$W/mm^2$ refers to Watts per square millimeter

As shown in Table 1 and FIGS. 5 and 6, when a waveguide layer is formed, as a light emission area increases, brightness may increase. When the light emission area increases, the brightness increases according to a thickness of the waveguide layer. As further described above, after an emission layer has a maximum area, a waveguide layer and a reflection film are formed, and thus a resolution may be selected by selecting a portion of the reflection film through which light is emitted. Due to an increase in the portion through which light is emitted from the entire maximum area of the emission layer, brightness and light efficiency may be increased.

As described above, an inorganic EL device according to the one or more of the above embodiments provides improved brightness and improved light efficiency and is thin and flexible. Moreover, an inorganic EL device manufacturing method according to the one or more of the above embodiments is simplified because of a simplified structure of an inorganic EL device.

What is claimed is:

1. An inorganic electroluminescent device comprising:

a lower electrode;

a dielectric layer disposed on the lower electrode;

an inorganic emission layer disposed on the dielectric layer;

an upper electrode disposed on the inorganic emission layer;

a waveguide layer disposed on the upper electrode, having a first surface adjacent to the upper electrode, and having a second surface opposite and parallel to the first surface; and a reflection film partially coating the second surface of the waveguide layer and comprising an emission portion through which light is emitted.

2. The inorganic EL device of claim 1, wherein a thickness of the waveguide layer is between about 0.5 times and about 5 times greater than a width of the emission portion.

3. The inorganic EL device of claim 1, wherein the waveguide layer comprises a material selected from the group consisting of polydimethylsiloxane, SU-8 polymer and a combination comprising at least one of the foregoing materials.

4. The inorganic EL device of claim 1, wherein a light-emission area of the inorganic EL device is between about 1.1 times and about 3 times greater than an area of a pixel, which is defined as an area where the lower and upper electrodes overlap each other.

5. The inorganic EL device of claim 1, further comprising a dielectric layer disposed between the inorganic emission layer and the upper electrode.

6. The inorganic EL device of claim 1, wherein the inorganic emission layer comprises a red phosphor, a green phosphor, a blue phosphor or a combination comprising at least one of the foregoing phosphors.

7. An inorganic electroluminescent device comprising:

a substrate;

a waveguide layer disposed on a bottom surface of the substrate, having a first surface adjacent to the substrate, and having a second surface opposite and parallel to the first surface;

a reflection film partially coating the second surface of the waveguide layer and comprising an emission portion through which light is emitted;

a lower electrode disposed on a top surface of the substrate;

an inorganic emission layer disposed on the lower electrode;

a dielectric layer disposed on the inorganic emission layer; and an upper electrode disposed on the dielectric layer.

8. The inorganic EL device of claim 7, wherein a thickness of the waveguide layer is between about 0.5 times and about 5 times greater than a width of the emission portion.

9. The inorganic EL device of claim 8, wherein a light-emission area of the inorganic EL device is between about 1.1 times and about 3 times greater than an area of a pixel, which is defined as an area where the lower and upper electrodes overlap each other.

10. The inorganic EL device of claim 7, wherein the waveguide layer comprises a material selected from the group consisting of polydimethylsiloxane, SU-8 polymer and a combination comprising at least one of the foregoing materials.

11. The inorganic EL device of claim 7, further comprising a dielectric layer disposed between the inorganic emission layer and the lower electrode.

12. The inorganic EL device of claim 7, wherein the inorganic emission layer comprises a red phosphor, a green phosphor, a blue phosphor or a combination comprising at least one of the foregoing phosphors.

13. A method of manufacturing an inorganic electroluminescent device, the method comprising:

sequentially disposing a lower electrode, a dielectric layer, an inorganic emission layer and an upper electrode;

disposing a waveguide layer on the upper electrode, the waveguide layer having a first surface adjacent to the upper electrode and having a second surface opposite and parallel to the first surface; and partially coating the second surface of the waveguide layer with a reflection film comprising an emission portion through which light is emitted to manufacture the inorganic electroluminescent device.

14. The method of claim 13, wherein the waveguide layer is disposed using a photolithographic process.

15. The method of claim 13, wherein the waveguide layer is disposed using an imprint process.

16. A method of manufacturing an inorganic electroluminescent device, the method comprising:

sequentially disposing a lower electrode, an inorganic emission layer, a dielectric layer and an upper electrode;

disposing a waveguide on the lower electrode, the waveguide having a first surface adjacent to the lower electrode and having a second surface opposite and parallel to the first surface; and disposing a reflection film on the second surface of the waveguide, wherein the reflection film has an emission portion through which light is emitted to manufacture the inorganic electroluminescent device.

17. The method of claim 16, further comprising disposing a substrate, the substrate interposed between the waveguide and the lower electrode.

18. The inorganic EL device of claim 1, wherein the waveguide layer has third surfaces on opposite sides of the waveguide layer and the reflection film is further on the third surfaces.

19. The inorganic EL device of claim 7, wherein the waveguide layer has third surfaces on opposite sides of the waveguide layer and the reflection film is further on the third surfaces.

20. The method of claim 16, wherein the waveguide layer has third surfaces on opposite sides of the waveguide layer and the reflection film is further on the third surfaces.

* * * * *